US006286587B1

(12) United States Patent
Landry

(10) Patent No.: US 6,286,587 B1
(45) Date of Patent: Sep. 11, 2001

(54) FREEZE-PROTECTED HEAT EXCHANGER

(76) Inventor: André Landry, 790, rue Ducharme, Beloeil, Quebec (CA), J3G 5H5

( * ) Notice: Subject to any disclaimer, the term of this patent is extended or adjusted under 35 U.S.C. 154(b) by 0 days.

(21) Appl. No.: 09/519,570

(22) Filed: Mar. 6, 2000

(30) Foreign Application Priority Data

Jun. 16, 1999 (CA) ..... 2274724

(51) Int. Cl.[7] ..... F28B 1/00

(52) U.S. Cl. ..... 165/110; 165/134.1; 165/155; 165/DIG. 913

(58) Field of Search ..... 165/110, 111, 165/112, 113, 114, 134.1, 154, 155, DIG. 913

(56) References Cited

U.S. PATENT DOCUMENTS

| | | | | |
|---|---|---|---|---|
| 663,677 | * | 12/1900 | Kirker | 165/110 |
| 1,689,927 | * | 10/1928 | Newhouse | 165/111 |
| 1,792,090 | * | 2/1931 | Haupt | 165/110 |
| 1,847,608 | * | 9/1932 | Harnett | 165/110 |
| 2,238,952 | * | 4/1941 | Stacey, Jr. | 165/110 |
| 2,248,909 | * | 7/1941 | Russell | 165/110 |
| 2,365,497 | * | 12/1944 | Smith | 165/110 |
| 2,561,424 | * | 7/1951 | Spieth | 165/110 |
| 2,991,978 | * | 7/1961 | Jones | 165/110 |
| 3,026,092 | * | 3/1962 | Pellegrini | 165/110 |
| 3,705,621 | | 12/1972 | Schoonman | 165/112 |
| 3,903,962 | * | 9/1975 | Newton | 165/110 |
| 3,968,836 | | 7/1976 | Larinoff | 165/111 |
| 4,240,502 | | 12/1980 | Larinoff | 165/112 |
| 4,926,931 | | 5/1990 | Larinoff | 165/111 |
| 5,056,592 | | 10/1991 | Larinoff | 165/111 |
| 5,145,000 | | 9/1992 | Kluppel | 165/113 |
| 5,355,943 | | 10/1994 | Gonano et al. | 165/112 |
| 5,579,831 | * | 12/1996 | Brucher | 165/154 |
| 5,765,629 | | 6/1998 | Goldsmith et al. | 165/112 |
| 5,782,293 | * | 7/1998 | Sather | 165/110 |
| 5,787,970 | | 8/1998 | Larinoff | 165/111 |
| 5,795,446 | * | 8/1998 | Kirschmann | 165/111 |
| 6,148,908 | * | 11/2000 | Brucher | 165/154 |

* cited by examiner

*Primary Examiner*—Ira S. Lazarus
*Assistant Examiner*—Terrell McKinnon
(74) *Attorney, Agent, or Firm*—Goudreau Gage Dubuc

(57) ABSTRACT

The freeze-protected heat exchanger comprises a fluid supply header for receiving a pressurized heated fluid and a drain chamber coextending with the fluid supply header for collecting and draining cooled fluid. A plurality of heat exchanger tubes extends radially from the fluid supply header and drain chamber, and each comprise outer and inner pipes. The outer pipe has a heat-conductive wall, a proximal end in fluid communication with the drain chamber and a distal closed end. The inner pipe is disposed coaxially within the outer pipe, has a proximal end in fluid communication with the fluid supply header and comprises a plurality of first orifices through which the inner pipe is in fluid communication with the outer pipe. At least one second orifice through which the drain chamber is in fluid communication with the fluid supply header opens in the drain chamber. In freeze-protected operation, heated fluid from the fluid supply header is supplied to the inner pipes, heated fluid from the inner pipes is transferred to the respective outer pipes through the first orifices, heat from the heated fluid in the outer pipes is transferred to the outside, for example to a flow of air, through the heat-conductive walls of the outer pipes, cooled fluid from the outer pipes is collected and drained through the drain chamber, the second orifice produces a jet of heated fluid in the drain chamber to prevent the formation of ice preferably in the area of the drain outlet, and heat from the fluid supply member is also transferred to the drain chamber by conduction and radiation. The invention also relates to a face and by-pass heat exchanger unit including the above described freeze-protected heat exchanger.

28 Claims, 5 Drawing Sheets

FREEZE-PROTECTED HEAT EXCHANGER

BACKGROUND OF THE INVENTION

1. Field of the Invention

The present invention relates to heat exchangers, and more particularly to heat exchangers featuring anti-freeze protection of the condensate draining path.

2. Brief Description of the Prior Art

Although freeze protection is an important criteria in designing an air-cooled steam condenser, the systems of the prior art, after more than two decades of development, still present complex and costly solutions to that problem and/or are unable to prevent freezing under certain operating conditions.

A typical solution to reduce the risk of freezing in the tubes of a steam condenser is to use a bundle of more than one row of tubes successively traversed by the air flow. The first row is struck by the coldest air flow but only a portion of the steam supplied to the tubes can be condensed. The outlet of the first row is connected to the inlet of the next row which converts a further amount of steam into condensate but is contacted by preheated air. Hence, although the steam could be totally reduced to cooled condensate at that stage, freezing is prevented because of the higher temperature of the air flow striking that row.

Larinoff in U.S. Pat. No. 5,787,970 issued on Aug. 4, 1998 presents an improved solution based on that concept characterized by a mixed flow vertical tube bundle design, in which some of the tube rows conduct counterflow steam and condensate while others have parallel flow. The condensate is drained at the bottom of the bundle from a header connecting a parallel flow row to a successive counterflow row in the protected warm air zone and non-condensable gases are collected at the outlet header of the counterflow rows.

The main drawback of the above type of systems lies in their lower efficiency/cost ratio as the second pass tube rows provide less heat exchange than the others for a comparable size and manufacturing cost. Also, some risks of freezing in the condensate drain piping and in tubes next to the edges of the bundle are still present. Moreover, circulation of steam and condensate in counterflow may result in interaction between the two fluids that disrupts normal flow and heat transfer. U.S. Pat. No. 5,056,592 (Larinoff) issued on Oct. 15, 1991 offers a solution to that problem by providing baffling inside some of the tubes to channel and separate the upward bulk flow of steam and the downward flow of condensate.

Another approach based on a similar principle is to use two rows of U-shaped tubes connected to a common steam supply as described in U.S. Pat. No. 3,705,621 (Schoonman) issued on Dec. 12, 1972. The tubes are so disposed that the air flow is successively striking the hottest legs of the first and second rows and then the coldest legs of the second and first tube rows.

Similarly, U.S. Pat. No. 4,926,931 (Larinoff) issued on May 22, 1990 presents a system in which the tubes are so arranged that steam flows from the input headers to the exposed legs of the inner and outer tube rows, and returns as condensate through the tube legs located in the protected warm air region in the middle of the tube bundle. The air flow thus successively strikes the hottest legs of the outer tube row, the coldest legs of the same row, the coldest legs of the second tube row and finally the hottest legs of that second row. Such an arrangement provides better protection to the exposed tubes especially at the top and bottom faces of the bundle. Moreover, the condensate drain headers extending in the protected region parallel and next to the steam supply headers provide some protection against freezing of the condensate by radiation heating. However, this system has drawbacks similar to the above concepts, as to the efficiency/cost ratio and still offers limited freezing protection especially in the U-shaped portions connecting the two legs of the finned tubes.

Another solution of comparable efficiency is described in U.S. Pat. No. 5,765,629 delivered to Goldsmith on Jun. 16, 1998 and uses a second stage vent condenser disposed in the same plane as a first stage condenser, both comprising bundles of vertically oriented tubes. The first stage operates at a higher steam pressure and consequently is easily drained from condensate and non-condensable gases into a lower header with excess steam. This header is connected to the upper header of the second stage condenser and to a hydraulically balanced common drain pot below the lower header. Non-condensable gases from the second stage flow countercurrently to be vented near the upper header. In this arrangement, freezing is controlled by continuous purging of the tube rows to avoid steam back-flow in the tube rows thereby eliminating trapping of condensate and non-condensable gases. However, this system is maintaining a constant level of condensate in the drain headers and the drain pot which are subject to freezing, particularly on the second stage condenser side.

Some solutions of the prior art have been specifically addressing potential freeze-up of the condensate drain lines. For instance, U.S. Pat. No. 3,968,836 (Larinoff) issued on Jul. 13, 1976 discloses a heat exchanger wherein leg seals connecting with outlets from individual condensate outlet headers are enclosed within a drain pot which is heated by uncondensed vapor from one of the outlet headers. In U.S. Pat. No. 4,240,502 issued on Dec. 23, 1980, Larinoff brings some improvements to the latter system, including a small hole in the drain pipe to purge the drain pot when the steam condensing system is shut down and applying some insulating material on the portion of the outlet header extending outside of the heated drain pot.

In U.S. Pat. No. 5,145,000, (Kluppel) issued on Sep. 8, 1992, a steam condensing system similar to the above has a tank receiving the condensate drain line from the drain pot. A steam line from the source of steam which also feeds the condenser, is connected to the upper end of the tank section receiving the drain line for supplying steam above the condensate level in the tank section. The steam heats the condensate drain line in the tank section to avoid freezing of the condensate.

In U.S. Pat. No. 5,355,943 (Gonano) issued on Oct. 18, 1994, steam from the source supplying the condenser is again connected to the upper end of a tank section receiving a condensate overflow drain duct from a drain vessel. Condensate is rain-like spread falling in the duct while the steam supplied to the tank goes up along the duct in countercurrent with the condensate, thus heating it on its passage to finally be sucked with non-condensable gases through the top portion of the drain vessel.

Although the latter vapor condensing system arrangements of the prior art significantly contribute to prevent freeze-up of the heat exchanger tube bundles or condensate drain lines, considerable drawbacks still limit their use on the market. Principally, their relative complexity significantly increases the system manufacturing and maintenance costs, while some efficiency of the heat transfer is lost and most of these systems still present risks of freezing especially if they are operated outside of their optimal vapour pressure conditions.

There is thus a need for an improved air-cooled vapor condensing system providing freeze protection over a wide range of operating conditions as required in applications such as heating of buildings.

OBJECT OF THE INVENTION

The main object of the present invention is therefore to provide a freeze-protected heat exchanger which overcomes the limitations and drawbacks of the above described prior art.

SUMMARY OF THE INVENTION

More specifically, in accordance with the invention as broadly claimed, there is provided a freeze-protected heat exchanger comprising:

a fluid supply member for connection to a source of condensable heated fluid;

a drain chamber coextending with the fluid supply member, and comprising a drain outlet;

a plurality of heat exchanger tubes extending from the fluid supply member and drain chamber, each heat exchanger tube comprising:

a first pipe having a heat-conductive wall, and a proximal end in fluid communication with the drain chamber;

a second pipe coextending with the first pipe, and having a proximal end in fluid communication with the fluid supply member; and at least one first orifice through which the first pipe is in fluid communication with the second pipe; and at least one second orifice through which the drain chamber is in fluid communication with the fluid supply member.

In operation, heated fluid is supplied from the fluid supply member to the second pipes, heated fluid from the second pipes is transferred to the respective first pipes through the first orifices, heat from the heated fluid in the first pipes is transferred to the outside of the first pipes through the heat-conductive walls, cooled fluid from the first pipes is collected and drained through the drain chamber and drain outlet, and the second orifice produces a jet of heated fluid in the drain chamber to prevent the formation of ice in the drain chamber.

In accordance with preferred embodiments of the invention:

the second orifice opens in the drain chamber in the area of the drain outlet;

the first pipe comprises an outer pipe having the heat-conductive wall and a distal closed end, the second pipe comprises an inner pipe having an inner pipe wall and disposed within the outer pipe with a space between the inner and outer pipes, and the first orifice extends through the inner pipe wall;

the fluid supply member and the drain chamber are substantially elongated and coaxial to each other, and the heat exchanger tubes extend substantially radially from the fluid supply member and drain chamber.

the heat exchanger tubes are generally horizontal with a slight slope toward the fluid supply member and drain chamber to enable draining of the cooled fluid from the first pipes toward the drain chamber by gravity;

each outer pipe comprises at least one outer heat-conductive fin to enhance heat transfer from the heat-conductive wall of the outer pipe to the outside, this fin comprising a helical extruded fin integral with the outer pipe to further prevent dilatation of the outer pipe and thus prevent formation of ice in the outer pipe;

the coextending fluid supply member and drain chamber are elongated, the heat exchanger tubes are arranged in bundles distributed along the length of the fluid supply member and drain chamber, each bundle of heat exchanger tubes comprise a plurality of rows of heat exchanger tubes, the heat exchanger tubes comprise first and second sets of heat exchanger tubes, and these first and second sets are diametrically opposite to each other about the fluid supply member and drain chamber;

the coextending fluid supply member and the drain chamber are substantially elongated and vertical;

the drain chamber comprises a bottom end provided with the drain outlet through which cooled fluid collected by the drain chamber from the first pipes is drained; and the fluid supply member comprises a header with a closed lower end proximate to the drain outlet, the lower end of the header being provided with the second orifice to produce the jet of heated fluid in view of preventing formation of ice in the region of the drain outlet of the bottom end of the drain chamber;

the fluid supply member comprises a heat-conductive wall located at least in part in the drain chamber to provide for transfer of heat from the heated fluid to the drain chamber in view of preventing formation of ice in the drain chamber;

each inner pipe has a distal end short of the distal closed end of the corresponding outer pipe, and the distal end of the inner pipe is open through at least one first orifice to transfer heated fluid from the inner pipe to the area of the outer pipe proximate to the distal closed end of the outer pipe; and a plurality of first orifices are distributed along the first and second pipes of each heat exchanger tubes, and the fluid supply member comprises a header provided with a plurality of heated fluid inlets distributed along the header.

The present invention also relates to a freeze-protected heat exchanger comprising:

a fluid supply member for connection to a source of condensable heated fluid, the fluid supply member having a first heat-conductive wall;

a drain chamber comprising a drain outlet and enclosing at least a portion of the fluid supply member, the fluid supply member and the drain chamber being substantially elongated, and the fluid supply member extending longitudinally within the drain chamber; and a plurality of heat exchanger tubes extending from the fluid supply member and drain chamber, each heat exchanger tube comprising:

a first pipe having a second heat-conductive wall, and a proximal end in fluid communication with the drain chamber;

a second pipe coextending with the first pipe, and having a proximal end in fluid communication with the fluid supply member; and at least one orifice through which the first pipe is in fluid communication with the second pipe;

In operation, heated fluid is supplied from the fluid supply member to the second pipes, heated fluid from the second pipes is transferred to the respective first pipes through the orifices, heat from the heated fluid in the first pipes is transferred to the outside of the first pipes through the second heat-conductive walls, cooled fluid from the first pipes is collected and drained through the drain chamber and drain outlet, and heat from the heated fluid in the fluid supply member is transferred to the drain chamber through the first heat-conductive wall in view of preventing formation of ice in the drain chamber.

Preferably, the fluid supply member and the drain chamber are substantially coaxial to each other.

The present invention further relates to a face and by-pass heat exchanger unit comprising the above described freeze-protected heat exchanger.

Freezing is prevented by direct contact of heated fluid, for example steam, and cooled fluid, for example condensate in the first pipes and by heating of the drain chamber by radiation, conduction and/or convection provided by the fluid supply member, and by heated fluid jet(s) directed toward the lower end of the drain chamber to prevent formation of ice near the drain outlet of the drain chamber.

The present invention presents, amongst others, the following advantages:

- freezing is prevented in the heat exchanger tubes as well as in the drain chamber and corresponding draining path;
- the freeze-protected heat exchanger complies with face and by-pass system arrangements for building heating applications as well as in any other type of heat exchanger and can be easily retrofitted into a wide range of existing conventional system units of different types, capacities and sizes;
- the freeze-protected heat exchanger is automatically drained from cooled fluid when shut-off;
- the freeze-protected heat exchanger presents a good overall energetic efficiency and an improved capacity/size ratio;
- the freeze-protected heat exchanger is economical to produce and maintain;
- the freeze-protected heat exchanger featuring generally horizontally oriented heat exchanging finned tubes connected to a substantially vertical steam supply header;
- the freeze-protected heat exchanger is functional with a single row of tubes or multiple parallel rows of tubes supplied by a common steam source through a common or separate headers; and
- the freeze-protected heat exchanger is not subject to disturbance of the steam flow by countercurrent condensate flow.

The objects, advantages and other features of the present invention will become more apparent upon reading of the following non restrictive description of a preferred embodiment thereof, given by way of example only with reference to the accompanying drawings.

BRIEF DESCRIPTION OF THE DRAWINGS

In the appended drawings:

FIG. 1*b* is an isometric rear view of the face and by-pass heat exchanger unit of FIG. 1*a;*

DETAILED DESCRIPTION OF THE PREFERRED EMBODIMENT

Figure 1A:
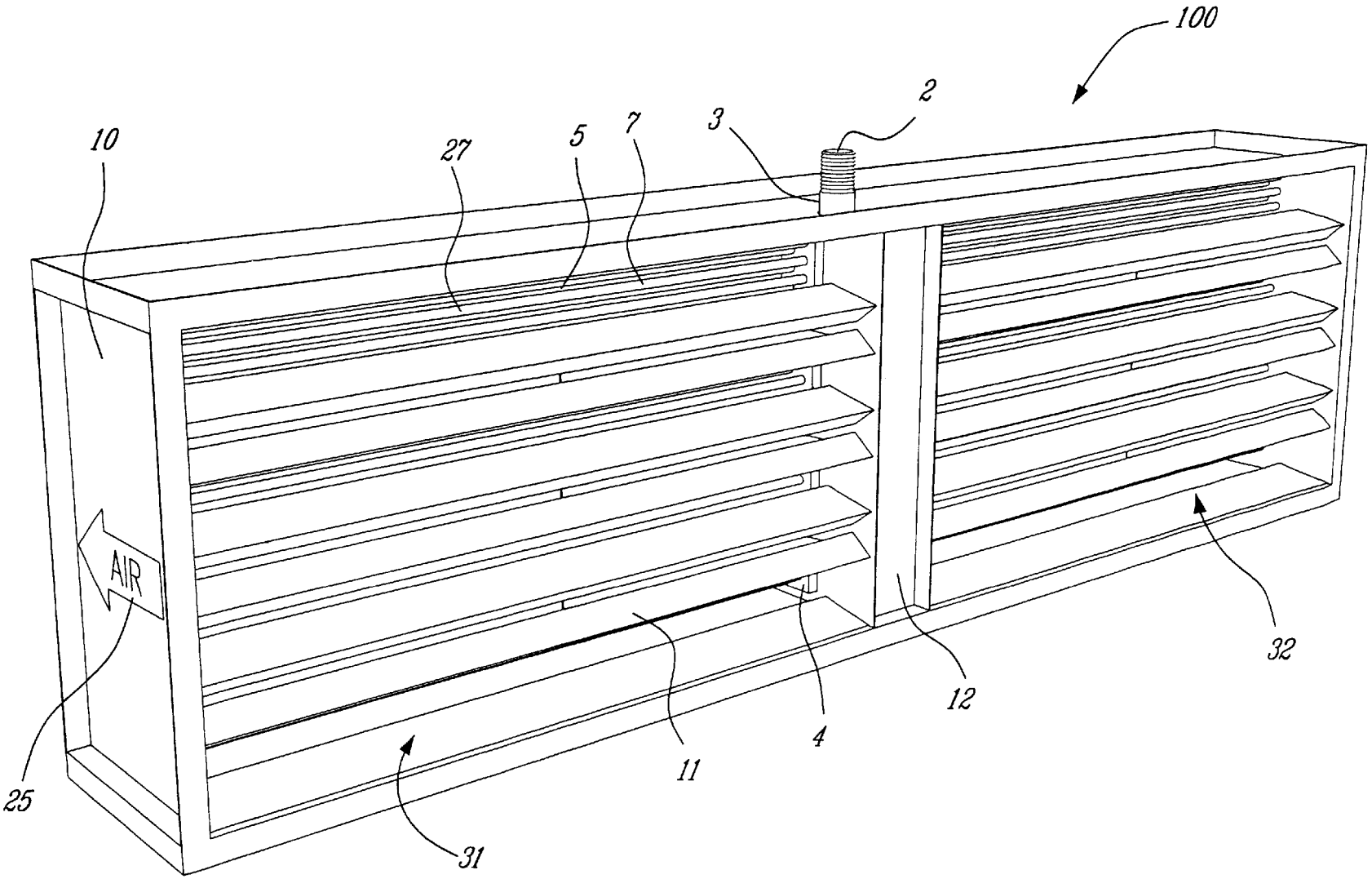
FIG. 1*a* is an isometric front view of a face and by-pass heat exchanger heating unit incorporating a freeze-protected heat exchanger according to the present invention.

In the appended drawings, similar reference numerals refer to similar parts throughout the various figures.

The preferred embodiment of the freeze-protected steam operated heat exchanger according to the present invention will now be described in detail referring to the appended drawings.

A face and by-pass heat exchanger unit 100 is illustrated in FIG. 1. This face and by-pass heat exchanger unit incorporates the preferred embodiment of the freeze-protected heat exchanger 1 (FIG. 2). In this preferred embodiment, the freeze-protected heat exchanger 1 is steam operated. Of course, use of any other type of condensable heated fluid could be contemplated. The face and by-pass heat exchanger unit (FIG. 1) comprises a housing 10 in which the freeze-protected heat exchanger 1 (FIG. 2) is installed.

Figures 2A, 2B, 2C:
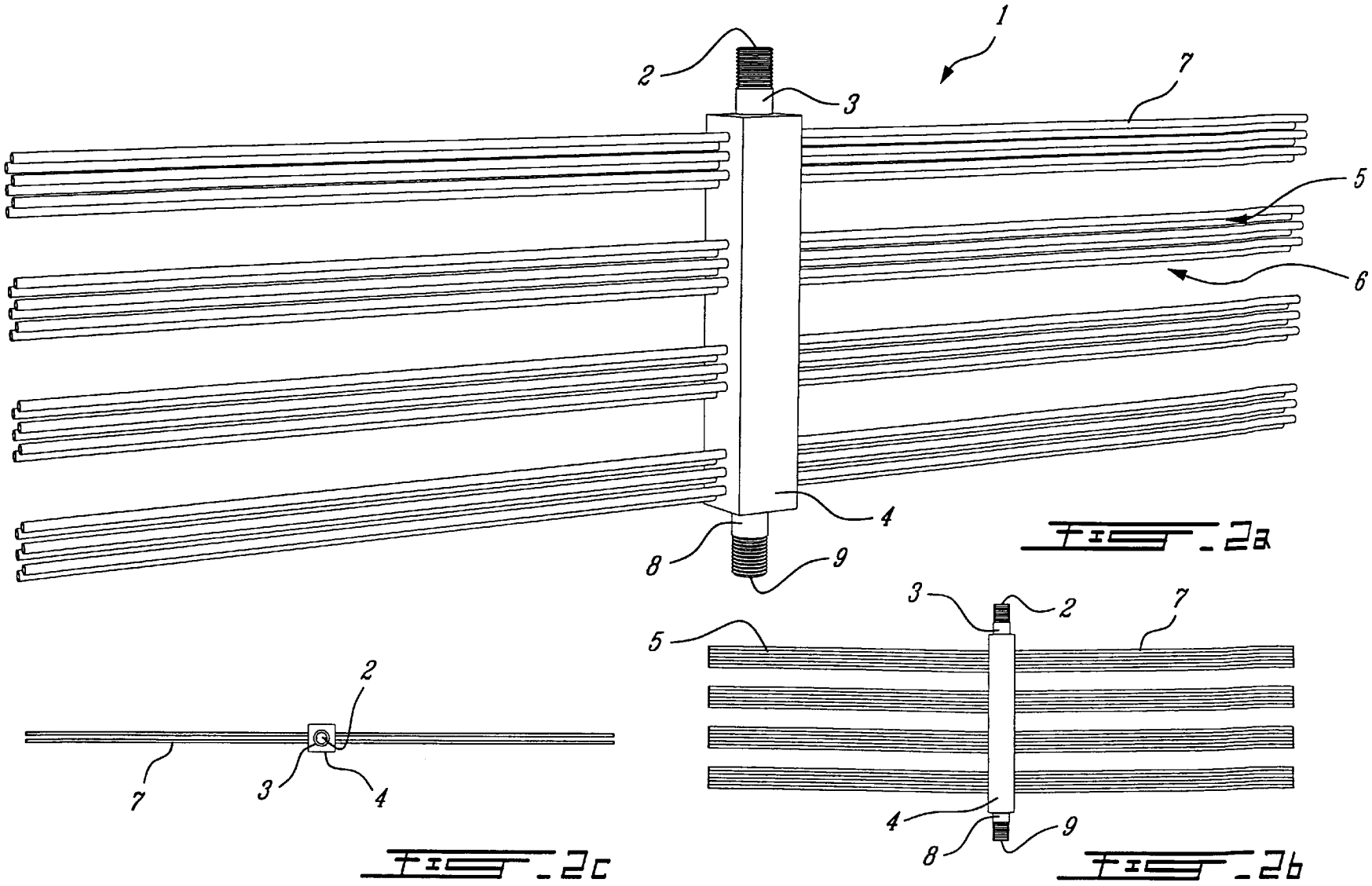
FIG. 2*a* is an isomeric front view of a freeze-protected heat exchanger according to the present invention, in which fins of the outer tubes are not shown.
FIG. 2*b* is a front elevation view of the freeze-protected heat exchanger of FIG. 2*a;*
FIG. 2*c* is a top view of the freeze-protected heat exchanger of FIG. 2*a;*

Referring to FIG. 1, housing 10 defines a pair of airflow passages 31 and 32 each provided with a remotely adjustable front set of air deflectors 11 (FIG. 1*a*) for:

- directing a predetermined portion of the incoming air flow (see arrow 25) through bundles 5 of heat exchanger tubes 7 forming part of the freeze-protected heat exchanger 1 (better shown in FIGS. 2*a*, 2*b* and 2*c*; and
- directing the remaining portion of the incoming air flow 25 toward by-pass zones such as 27 located between the bundles 5 of heat exchanger tubes 7;

and a remotely adjustable rear set of air deflectors 23 (FIG. 1*b*) for:

- blocking passage of air through the by-pass zones; or
- blocking passage of air through the bundles 5 of heat exchanger tubes by blocking the exit downstream these bundles 5.

Each bundle 5 comprises at least one vertical row of generally horizontal heat exchanger tubes 7 connected at one end to generally vertical steam supply header 3 and condensate drain chamber 4.

Figure 3:
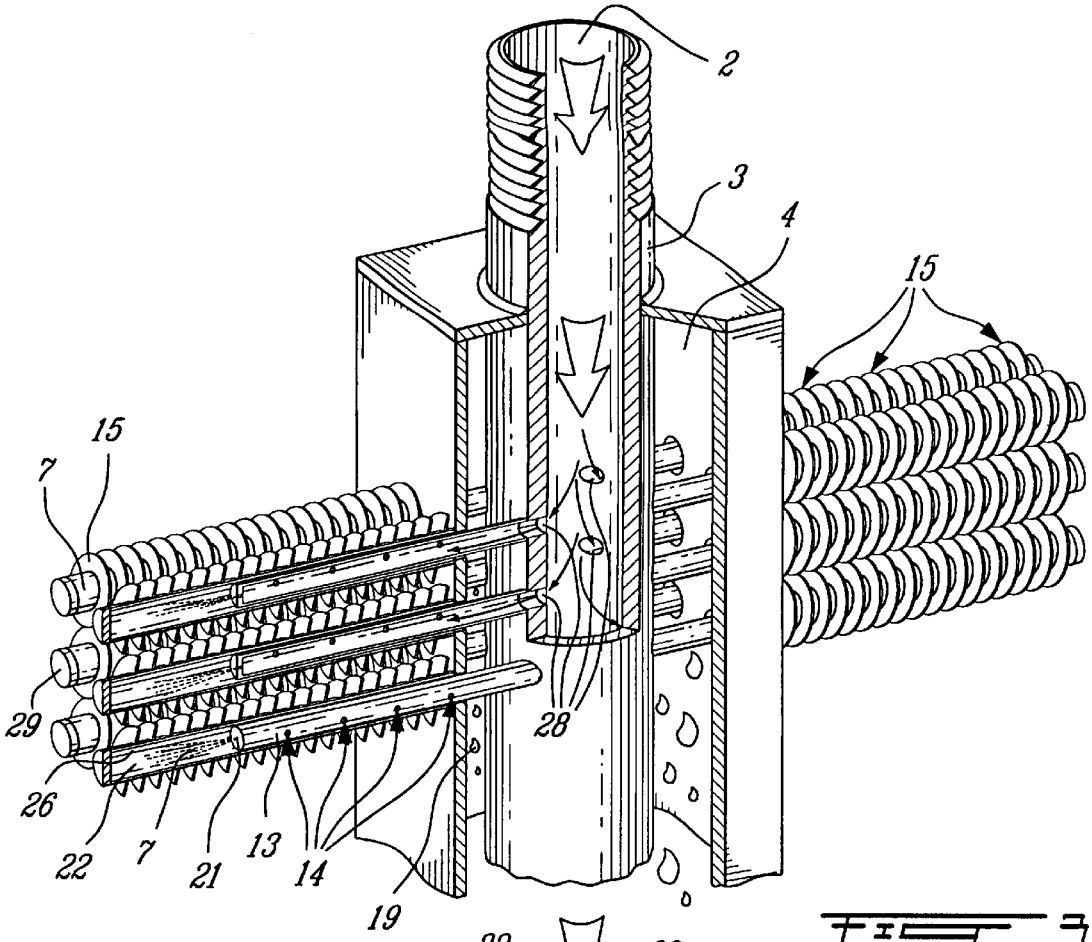
FIG. 3 is a perspective, partly cross sectional view of an upper portion of the freeze-protected heat exchanger of FIGS. 2*a*, 2*b* and 2*c*, showing steam distribution and condensate return paths.
Figure 4:
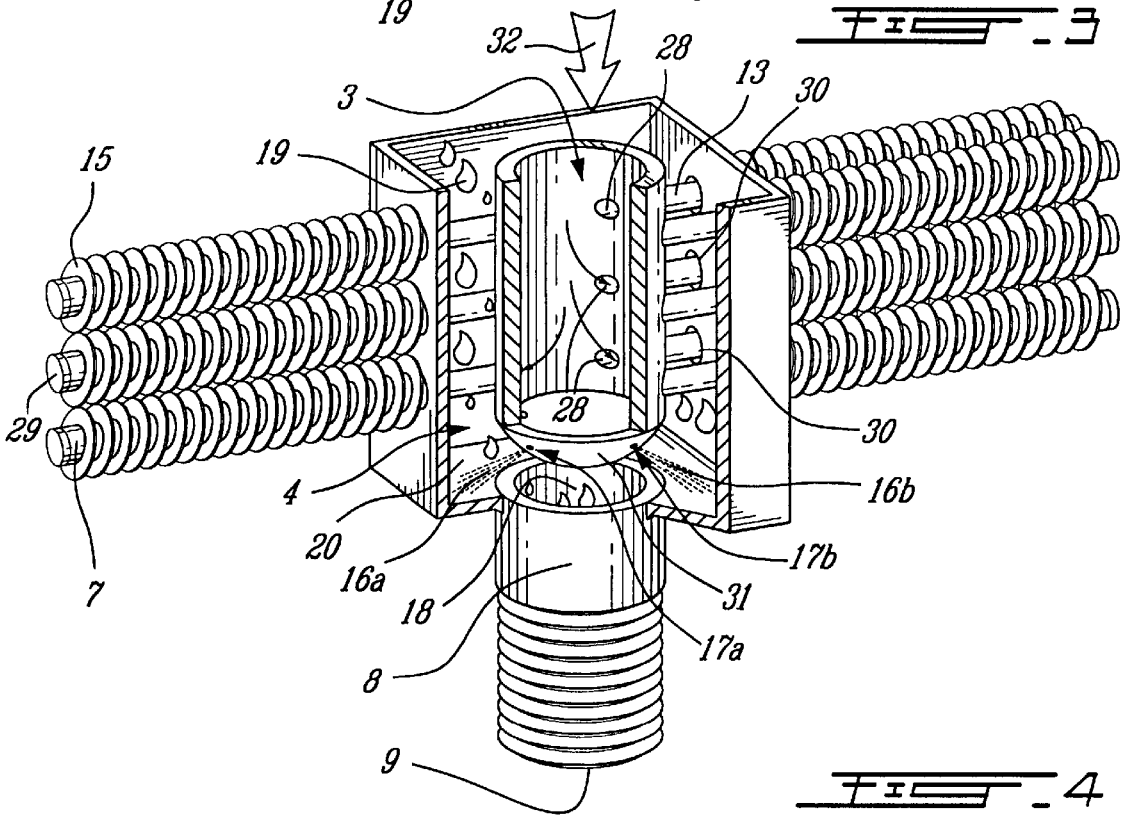

As better shown in FIGS. 2*a* and 3, the steam supply header 3 is substantially cylindrical and extends substantially vertically and coaxially in the box-like condensate drain chamber 4. The steam supply header 3 comprises an upper, threaded steam inlet connector 2. Referring to FIG.

1*a*, the steam supply header 3 and the box-like condensate drain chamber 4 are installed in a substantially central closed housing portion 12 of the face and by-pass heat exchanger unit 100.

In FIGS. 1*a*, 1*b*, 2*a*, 2*b* and 2*c* diametrically opposite sets of superposed and substantially radially extending bundles 5 of heat exchanger tubes 7 are illustrated. However, it shall be deemed that in smaller units having less heating capacity, the housing portion 12 and the enclosed steam supply header 3 and drain chamber 4 may be located at one end of the unit 100 comprising a single set of superposed bundles 5 of heat exchanger tubes 7 extending substantially radially from supply header 3. In this case, to improve distribution of the steam into the inner pipes 13 (FIG. 3) of the superposed bundles 5, a plurality of steam inlets (not shown) can be provided in the side wall of supply header 3. Preferably, these steam inlets will be distributed along the length of the header 3 and disposed diametrically opposite to the single set of superposed bundles 5 of heat exchanger tubes 7. As described hereinafter and as illustrated in FIG. 3, each heat exchanger tube 7 is formed of an heat-conductive outer pipe 26 and an inner pipe 13.

In this type of application, a substantially constant steam flow is established through the steam inlet connector 2 while the temperature of the air emerging downstream of the heat exchanger unit 100 is modulated according to the position of the cooperating series of air deflectors 11 and 23. Both series of air deflectors 11 and 23 are connected together through connecting rods such as 24 and actuated through an external actuator such as an electric motor (not shown) to operate as follows:

- in a face mode, the defectors 11 direct the incoming air flow toward the bundles 5 of heat exchanger tubes 7, while the deflectors 23 block the by-pass zones; and
- in a by-pass mode, the deflectors 11 direct the incoming air toward the by-pass zones, while the deflectors 23 block the exit downstream the bundles 5 of heat exchanger tubes 7.

Intermediate positions of the deflectors 11 and 23 may be adopted by the face and by-pass heat exchanger unit 100 under the control of the external actuator so as to modulate the proportion of air flowing through the bundles 5 of heat exchanger tubes 7 and being heated by the heat exchanger 1, thus controlling the average temperature of the air flow downstream the face and by-pass heat exchanger unit 100.

The housing portion 12 provides some protection of the condensate drain chamber 4 against contact by incoming cold air and can be filled with insulating material to further improve insulating properties. FIGS. 2*a* and 2*b* illustrate a generally vertical condensate drain pipe 8 extending from the bottom of the condensate drain chamber 4. FIGS. 2*a* and 2*b* also illustrate a threaded condensate outlet connector 9 of the condensate drain pipe 8.

FIG. 3 illustrates the upper portion of the freeze-protected heat exchanger 1 showing the structure of the steam distribution and condensate return paths. Steam is supplied through the inlet connector 2 of the steam supply header 3. The inner pipes 13 of the heat exchanger tubes 7 are each provided with two diametrically opposite series of orifices 14 distributed therealong. The inner pipes 13 extend generally horizontally and radially from the steam supply header 3 and are in fluid communication therewith (see openings such as 28). Each inner pipe 13 therefore extends through a wall of the condensate drain chamber 4 and is mounted in a corresponding outer pipe 26 coaxially therewith with an annular spacing between the inner 13 and outer 26 pipes. On the other hand, each outer pipe 26 is heat-conductive and provided with a rigid heat-conductive integral helical extruded fin 15 to enhance heat transfer from the heat-conductive wall of the output pipe 26 to the airflow 25. Also, each outer pipe 26 has a distal closed free end 29 and a proximal end 30 opening in the condensate drain chamber 4. More specifically, the proximal end 30 of each outer pipe 26 is connected to and extends through a side wall of the condensate drain chamber 4, in fluid communication therewith. As illustrated, the inner pipes 13 extend into the respective outer pipes 26 up to a few inches short from the distal closed free ends 29. These inner pipes 13 preferably comprise respective axial end orifices 21 to produce axial steam jets 22 toward the closed free ends of the respective outer pipes 26. All the inner 13 and outer 26 pipes are slightly sloping downwardly toward the condensate drain chamber 4 to assure proper draining of the condensate 19 from the outer pipes 26 in the chamber 4 by gravity. A slope of the order of 2% fulfills this purpose.

Those of ordinary skill in the art will appreciate that the steam supplied by a steam source (not shown) through inlet connector 2 to the steam supply header 3 is distributed in the inner pipes 13 and subsequently transferred to the outer pipes 26 through the orifices 14 and 21. Again, it shall be noted that in large units comprising many superposed bundles 5 of heat exchanger tubes 7, more than one steam inlet can be provided along steam supply header 3 to better balance the distribution of steam into the inner pipes 13. Upon contact with the inner side of the air-cooled wall of finned outer pipes 26, heat from the steam is transferred to the airflow 25 through the finned outer pipes 26 and the steam condenses and flows by gravity as condensate 19 toward the drain chamber 4, rain-like spread falling along the walls thereof toward the bottom 20 (FIG. 4) of that chamber. Each row of heat exchanger tubes 7 in such an arrangement provides about twice the heat-transfer capacity of a conventional U-shaped tube design, thus reducing the size and cost for a face and by-pass heat exchanger unit 100 of given capacity.

The internal volume and the walls of the condensate drain chamber 4 are submitted to some heating from the steam supply header 3, thus preventing sub-cooling of the condensate and formation of ice in the chamber 4 or at the outlet (proximal ends 30) of the outer pipes 26. Moreover, the rigid extruded fins 15 provide the outer tubes 26 with a high resistance to dilatation which contribute to further prevent formation of ice. Although integral, extruded fins 15 are preferred, use of some other fin configuration such as flat or corrugated plates, or flat or corrugated rectangular individual fins of an overlapped or footed "L" design could be contemplated with acceptable results.

Figure 4:
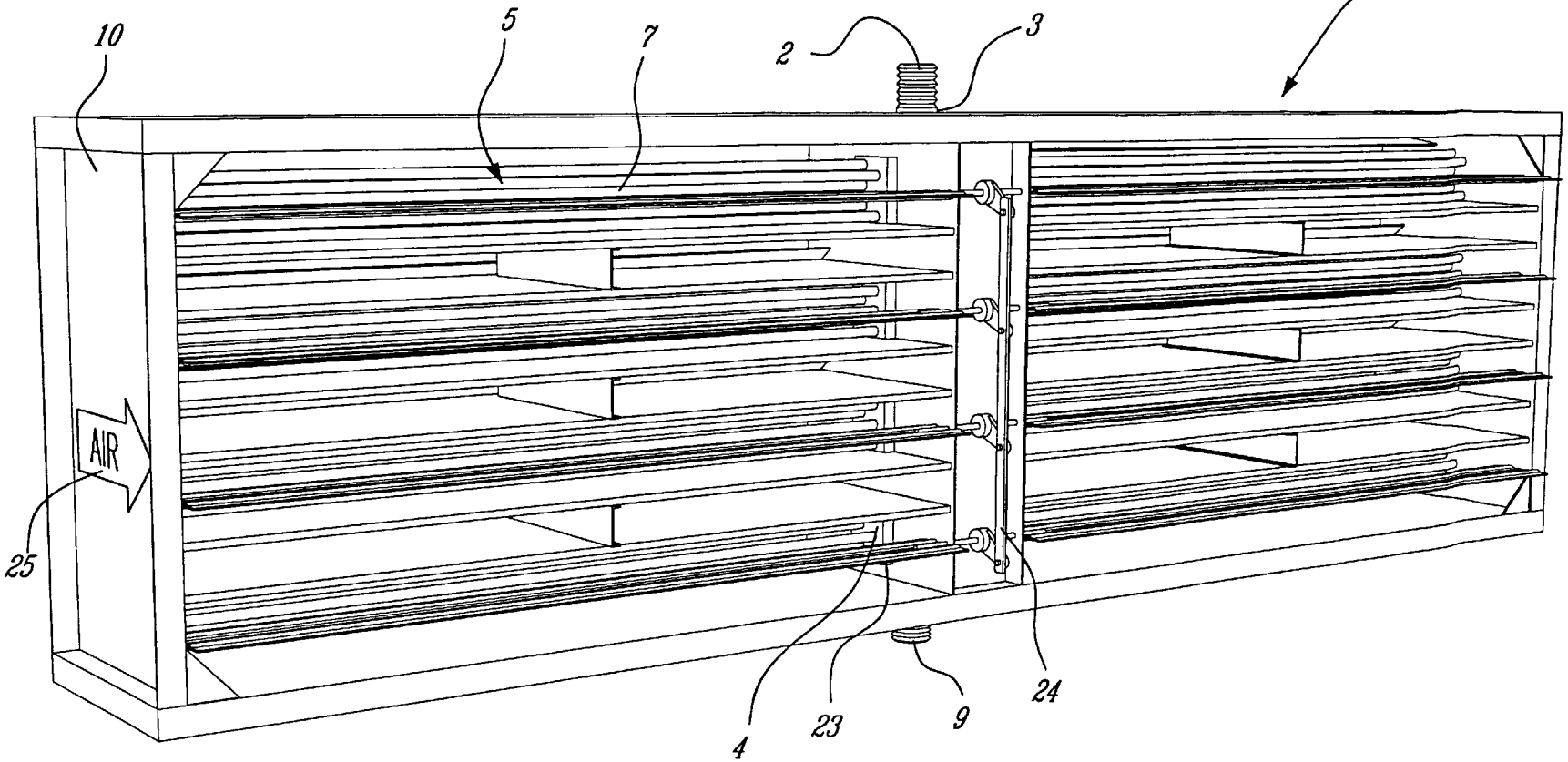
FIG. 4 is a perspective, partly cross sectional view of a lower portion of the freeze-protected heat exchanger of FIGS. 2*a*, 2*b* and 2*c*, showing condensate drain path and the heating steam jets.

FIG. 4 illustrates the lower portion of the freeze-protected heat exchanger 1 to show the structure of the condensate drain path. The condensate 19 dripping along the internal walls of drain chamber 4 hits the bottom 20 and flows through an inlet 18 of the condensate drain pipe 8 and is returned to the steam trap and remaining components of the system (not shown) via the threaded condensate outlet connector 9. Two jets of steam 16*a* and 16*b* are respectively escaping from two small orifices 17*a* and 17*b* of diameter depending on the pressure of the steam supply, preferably provided in the bottom wall 31 of the steam supply header 3 and so positioned as to direct these steam jets 16*a* and 16*b* preferably toward the front (cold air side) corners of the bottom 20 of the condensate drain chamber 4 thus avoiding any build-up of ice at the bottom 20 and at the inlet 18 of the condensate drain pipe 8. The orifices 17*a* and 17*b* also serve to drain the condensed steam from the steam supply header 3 when the steam-producing heating device (not shown) is shut-off and the steam flow 32 is interrupted at the steam inlet connector 2.

Alternatively, more than two orifices such as 17*a* and 17*b* can be provided to produce more than two corresponding jets of steam such as 16*a* and 16*b*.

In the case of the two orifices 17*a* and 17*b*, these orifices can be positioned at a higher level on the vertical and cylindrical wall of the header 3 to both heat and prevent build-up of ice throughout the entire drain chamber 4. In the case of a number of orifices larger than 2, the orifices can be distributed vertically on the vertical, cylindrical wall of the header 3 again to both heat and prevent build-up of ice throughout the entire drain chamber 4.

Furthermore, a closure member (not shown) can be provided for manually or automatically controlling the opening and closing of the orifices as a function of different operating conditions such as external air temperature.

Figure 5C:
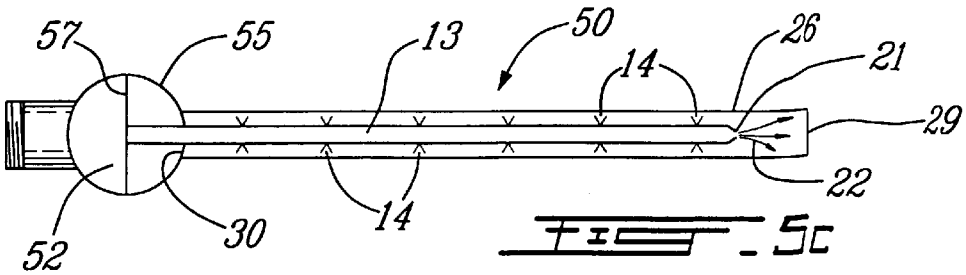
FIG. 5*c* is a top plan view of the coextending steam supply header and drain chamber of FIGS. 5*a* and 5*b*.
Figure 5B:
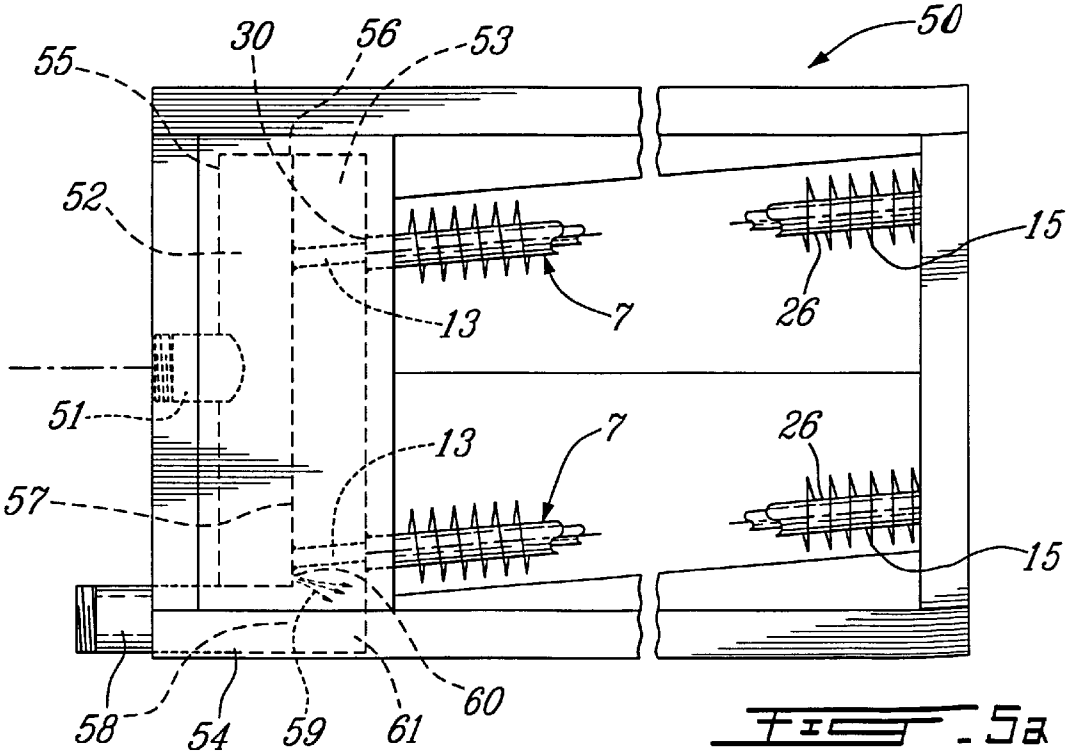
FIG. 5*b* is an elevational, end view of the coextending steam supply header and drain chamber of FIG. 5*a*.
Figure 5A:
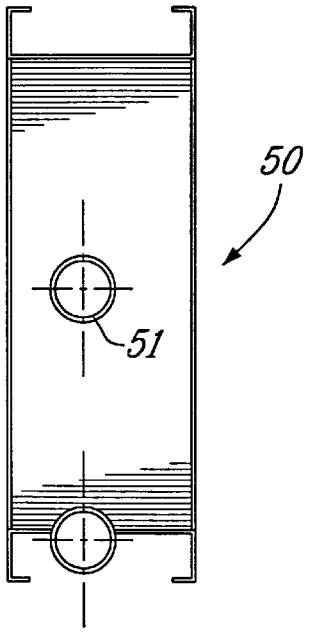
FIG. 5*a* is a side elevational view of a preferred embodiment of coextending steam supply header and drain chamber forming part of the freeze-protected heat exchanger according to the invention.

FIGS. 5*a*, 5*b*, and 5*c* illustrate an alternative embodiment 50 of the freeze-protected heat exchanger 1 showing the structure of the steam distribution and condensate return paths.

The embodiment 50 of FIGS. 5*a*, 5*b* and 5*c* comprises a steam supply header 52 and a condensate drain chamber 53 formed of a vertical tube 55 with a closed top end 56. A central vertical flat, heat-conductive wall 57 separates the vertical tube 55 into two halves of which one forms the header 52 and the other the drain chamber 53. The steam supply header 52 has closed top and bottom ends, while the drain chamber 53 has a closed top end but a bottom end 54 open to form a drain outlet 58.

Steam is supplied through an inlet connector 51 of the steam supply header 52. As illustrated, inlet connector 51 is threaded for connection to a steam source (not shown). The inner pipes 13 of the heat exchanger tubes 7 are still provided with the two diametrically opposite series of orifices 14 (see FIGS. 5*c*) distributed therealong. The inner pipes 13 extend generally horizontally and radially from the steam supply header 52 and are in fluid communication therewith (see portions of inner pipes 13 extending through the drain chamber 53). Each inner pipe 13 therefore extends through a wall of the condensate drain chamber 53 and is mounted in a corresponding outer pipe 26 coaxially therewith with an annular spacing between the inner 13 and outer 26 pipes. On the other hand, each outer pipe 26 is heat-conductive and provided with a rigid heat-conductive integral helical extruded fin 15 to enhance heat transfer from the heat-conductive wall of the output pipe 26 to the airflow 25. Also, each outer pipe 26 has a distal closed free end 29 and a proximal end 30 opening in the condensate drain chamber 53. More specifically, the proximal end 30 of each outer pipe 26 is connected to and extends through a side wall of the condensate drain chamber 53, in fluid communication therewith. As illustrated in FIG. 5*c*, the inner pipes 13 extend into the respective outer pipes 26 up to a few inches short from the distal closed free ends 29. These inner pipes 13 preferably comprise respective axial end orifices 21 to produce axial steam jets 22 toward the closed free ends of the respective outer pipes 26. All the inner 13 and outer 26 pipes are slightly sloping downwardly toward the condensate drain chamber 53 to assure proper draining of the condensate from the outer pipes 26 in the chamber 53 by gravity. A slope of the order of 2% fulfills this purpose.

Those of ordinary skill in the art will appreciate that the steam supplied by a steam source (not shown) through the inlet connector 51 to the steam supply header 52 is distributed in the inner pipes 13 and subsequently transferred to the outer pipes 26 through the orifices 14 and 21. Again, it shall be noted that in large units comprising many superposed bundles 5 of heat exchanger tubes 7, more than one steam inlet such as 51 can be provided along steam supply header 52 to better balance the distribution of steam into the inner pipes 13. Upon contact with the inner side of the air-cooled wall of finned outer pipes 26, heat from the steam is transferred to the airflow 25 through the finned outer pipes 26 and the steam condenses and flows by gravity as condensate toward the drain chamber 53, rain-like spread falling along the walls thereof toward the bottom end 54 and drain outlet 58 (FIG. 5*a*) of that chamber. Each row of heat exchanger tubes 7 in such an arrangement provides about twice the heat-transfer capacity of a conventional U-shaped tube design, thus reducing the size and cost for a face and by-pass heat exchanger unit 100 of given capacity.

The internal volume and the walls of the condensate drain chamber 53 are submitted to some heating through the heat-conductive wall 57 from the steam supply header 52, thus preventing sub-cooling of the condensate and formation of ice in the chamber 53 or at the outlet (proximal ends 30) of the outer pipes 26. Moreover, the rigid extruded fins 15 provide the outer tubes 26 with a high resistance to dilatation which contribute to further prevent formation of ice. Although integral, extruded fins 15 are preferred, use of some other fin configuration such as flat or corrugated plates, or flat or corrugated rectangular individual fins of an overlapped or footed "L" design could be contemplated with acceptable results.

The condensate dripping along the internal walls of drain chamber 53 hits the bottom 54 and flows through the drain outlet 58 and is returned to the steam trap or remaining components of the system (not shown) via this drain outlet 58. Drain outlet 58 is threaded for connection to the steam trap or remaining components of the system. At least one jet of steam 59 escapes from a small orifice 60 of a diameter depending on the pressure of the steam supply, preferably provided in the lower portion of wall 57 of the steam supply header 52 and so positioned as to direct this steam jet 59 preferably toward a cold air side corner 61 of the bottom 54 of the condensate drain chamber 53 thus avoiding any build-up of ice at the bottom 54 and at the drain outlet 58. The orifice 60 also serves to drain the condensed steam from the steam supply header 52 when the steam source (not shown) is shut-off and the steam flow is interrupted at the steam inlet 51.

Alternatively, a plurality of orifices such as 60 can be provided to produce a plurality of corresponding jets of steam such as 59.

In the case of the single orifice 60, this orifice can be positioned at a higher level on the wall 57 to both heat and prevent build-up of ice throughout the entire drain chamber 53. In the case of a plurality of orifices such as 60, the orifices can be distributed vertically on the wall 57 again to both heat and prevent build-up of ice throughout the entire drain chamber 53.

Furthermore, a closure member (not shown) can be provided for manually or automatically controlling the opening and closing of the single or plurality of orifices such as 60, as a function of different operating conditions such as external air temperature.

Therefore, it will be apparent to those of ordinary skill in the art that the freeze-protected heat exchanger 1 of the present invention can be advantageously used for efficiently transferring heat from a steam flow 32 to an air flow 25 potentially below the freezing point of water, without causing damages or malfunctions due to freezing of steam condensate, thus overcoming the drawbacks of the prior art devices.

Although the present invention has been described hereinabove by way of a preferred embodiment thereof, this embodiment can be modified at will, within the scope of the appended claims, without departing from the spirit and nature of the subject invention.

For instance, it would be obvious for one of ordinary skill in the art to use the freeze-protected heat exchanger of the present invention with a different arrangement of bundles and rows of tubes, in a wide range of sizes and power capacities and/or to use two units forming a A-shaped condenser for condensing steam or other condensable heated fluid at the outlet of turbines in power plants. Moreover, the heat exchanger can be retrofitted into many types of existing units.

What is claimed is:

1. A freeze-protected heat exchanger comprising:

a fluid supply member for connection to a source of condensable heated fluid;

a drain chamber coextending with the fluid supply member, and comprising a drain outlet;

a plurality of heat exchanger tubes extending from the fluid supply member and drain chamber, each heat exchanger tube comprising:

a first pipe having a heat-conductive wall, and a proximal end in fluid communication with the drain chamber;

a second pipe coextending with the first pipe, and having a proximal end in fluid communication with the fluid supply member; and at least one first orifice through which the first pipe is in fluid communication with the second pipe; and at least one second orifice through which the drain chamber is in fluid communication with the fluid supply member;

whereby, in operation, heated fluid is supplied from the fluid supply member to the second pipes, heated fluid from the second pipes is transferred to the respective first pipes through said first orifices, heat from the heated fluid in the first pipes is transferred to the outside of said first pipes through said heat-conductive walls, cooled fluid from the first pipes is collected and drained through the drain chamber and drain outlet, and said at least one second orifice produces a jet of heated fluid in the drain chamber to prevent the formation of ice in said drain chamber.

2. A freeze-protected heat exchanger as recited in claim 1, wherein said at least one second orifice opens in the drain chamber in the area of the drain outlet.

3. A freeze-protected heat exchanger as recited in claim 1, wherein:

the first pipe comprises an outer pipe having said heat-conductive wall and a distal closed end;

the second pipe comprises an inner pipe having an inner pipe wall and disposed within the outer pipe with a space between the inner and outer pipes; and said at least one first orifice extends through the inner pipe wall.

4. A freeze-protected heat exchanger as recited in claim 1, wherein the fluid supply member and the drain chamber are substantially elongated and coaxial to each other, and wherein the heat exchanger tubes extend substantially radially from the fluid supply member and drain chamber.

5. A freeze-protected heat exchanger as recited in claim 1, wherein the heat exchanger tubes are generally horizontal with a slight slope toward the fluid supply member and drain chamber to enable draining of the cooled fluid from the first pipes toward the drain chamber by gravity.

6. A freeze-protected heat exchanger as recited in claim 3, wherein each outer pipe comprises at least one outer heat-conductive fin to enhance heat transfer from the heat-conductive wall of the outer pipe to the outside.

7. A freeze-protected heat exchanger as recited in claim 6, wherein said at least one fin comprises a helical extruded fin integral with the outer pipe to further prevent dilatation of said outer pipe and thus preventing formation of ice in the outer pipe.

8. A freeze-protected heat exchanger as recited in claim 1, wherein the coextending fluid supply member and drain chamber are elongated, and wherein the heat exchanger tubes are arranged in bundles distributed along the length of the fluid supply member and drain chamber.

9. A freeze protected heat exchanger as recited in claim 8, wherein each bundle of heat exchanger tubes comprise a plurality of rows of heat exchanger tubes.

10. A freeze-protected heat exchanger as recited in claim 8, wherein the heat exchanger tubes comprise first and second sets of heat exchanger tubes, said first and second sets being diametrically opposite to each other about the fluid supply member and drain chamber.

11. A freeze-protected heat exchanger as recited in claim 1, wherein:

the coextending fluid supply member and the drain chamber are substantially elongated and vertical;

the drain chamber comprises a bottom end provided with said drain outlet through which cooled fluid collected by the drain chamber from the first pipes is drained; and the fluid supply member comprises a header with a closed lower end proximate to the drain outlet, the lower end of the header being provided with said at least one second orifice to produce said at least one jet of heated fluid in view of preventing formation of ice in the region of the drain outlet of the bottom end of the drain chamber.

12. A freeze-protected heat exchanger as recited in claim 1, wherein the fluid supply member comprises a heat-conductive wall located at least in part in the drain chamber to provide for transfer of heat from the heated fluid to the drain chamber in view of preventing formation of ice in said drain chamber.

13. A freeze-protected heat exchanger as recited in claim 3, wherein the inner pipe has a distal end short of the distal closed end of the outer pipe, and wherein the distal end of the inner pipe is open through at least one first orifice to transfer heated fluid from the inner pipe to the area of the outer pipe proximate to the distal closed end of said outer pipe.

14. A freeze-protected heat exchanger as recited in claim 1, comprising a plurality of first orifices distributed along the first and second pipes.

15. A freeze-protected heat exchanger as recited in claim 1, wherein said fluid supply member comprises a header provided with a plurality of heated fluid inlets distributed along said header.

16. A face and by-pass heat exchanger unit comprising:

a freeze-protected heat exchanger comprising:

an elongated, substantially vertical fluid supply member for connection to a source of condensable heated fluid;

an elongated, substantially vertical drain chamber coextending with the fluid supply member, and comprising a drain outlet;

a set of bundles of heat exchanger tubes extending generally radially from the fluid supply member and drain chamber and distributed along said fluid supply member and drain chamber, each heat exchanger tube comprising:

a first pipe having a heat-conductive wall, and a proximal end in fluid communication with the drain chamber;

a second pipe coextending with the first pipe, and having a proximal end in fluid communication with the fluid supply member; and at least one first orifice through which the first pipe is in fluid communication with the second pipe; and at least one second orifice through which the drain chamber is in fluid communication with the fluid supply member, said at least one second orifice opening in the drain chamber in the area of the drain outlet;

whereby, in operation, heated fluid is supplied from the fluid supply member to the second pipes, heated fluid from the second pipes is transferred to the respective first pipes through said first orifices, heat from the heated fluid in the first pipes is transferred to the outside of said first pipes through said heat-conductive walls, cooled fluid from the first pipes is collected and drained through the drain chamber and drain outlet, and said at least one second orifice produce a jet of heated fluid in the drain chamber to prevent the formation of ice in the area of the drain outlet;

a housing comprising:

at least one airflow passage, said bundles of heat exchanger tubes extending across the airflow passage whereby heat from the heated fluid in the first pipes is transferred to the air flow through the heat-conductive walls of the first pipes; and air deflectors extending across the airflow passage to selectively direct the airflow through the bundles of heat exchanger tubes and/or in by-pass zones of the airflow passage between the bundles of heat exchanger tubes.

17. A face and by-pass heat exchanger unit as recited in claim 16, further comprising a closed housing portion for receiving the fluid supply header and the drain chamber.

18. A face and by-pass heat exchanger unit as recited in claim 16, wherein the closed housing portion is heat-insulated.

19. A face and by-pass heat exchanger unit as recited in claim 16, wherein:

the first pipe comprises an outer pipe having said heat-conductive wall and a distal closed end;

the second pipe comprises an inner pipe having an inner pipe wall and disposed within the outer pipe with a space between the inner and outer pipes; and said at least one first orifice extends through the inner pipe wall.

20. A face and by-pass heat exchanger unit as recited in claim 16, wherein the fluid supply member and the drain chamber are substantially coaxial to each other.

21. A face and by-pass heat exchanger unit as recited in claim 16, wherein the heat exchanger tubes are generally horizontal with a slight slope toward the fluid supply member and drain chamber to enable draining of the cooled fluid from the first pipes toward the drain chamber by gravity.

22. A face and by-pass heat exchanger unit as recited in claim 19, wherein each outer pipe comprises at least one outer heat-conductive fin to enhance heat transfer from the heat-conductive wall of the outer pipe to the outside, and wherein said at least one fin comprises a helical extruded fin integral with the outer pipe to further prevent dilatation of said outer pipe and thus preventing formation of ice in the outer pipe.

23. A face and by-pass heat exchanger unit as recited in claim 16, wherein each bundle of heat exchanger tubes comprise a plurality of rows of heat exchanger tubes.

24. A face and by-pass heat exchanger unit as recited in claim 16, wherein the housing comprises first and second airflow passages, and the set of bundles of heat exchanger tubes comprise first and second subsets of bundles of heat exchanger tubes, said first and second subsets being diametrically opposite to each other about the fluid supply header and drain chamber.

25. A face and by-pass heat exchanger unit as recited in claim 16, wherein:

the drain chamber comprises a bottom end provided with said drain outlet through which cooled fluid collected by the drain chamber from the first pipes is drained; and the fluid supply member comprises a header with a closed lower end proximate to the drain outlet, the lower end of the header being provided with said at least one second orifice to produce said at least one jet of heated fluid in view of preventing formation of ice in the region of the drain outlet of the bottom end of the drain chamber.

26. A face and by-pass heat exchanger unit as recited in claim 16, wherein the fluid supply member comprises a heat-conductive wall located at least in part in the drain chamber to provide for transfer of heat from the heated fluid to the drain chamber in view of preventing formation of ice in said drain chamber.

27. A face and by-pass heat exchanger unit as recited in claim 19, wherein the inner pipe has a distal end short of the distal closed end of the outer pipe, and wherein the distal end of the inner pipe is open through at least one first orifice to transfer heated fluid from the inner pipe to the area of the outer pipe proximate to the distal closed end of said outer pipe.

28. A face and by-pass heat exchanger unit as recited in claim 16, comprising a plurality of first orifices distributed along the first and second pipes, and wherein said fluid supply member comprises a header provided with a plurality of heated fluid inlets distributed along said header.

* * * * *